United States Patent [19]

Bokmiller

[11] Patent Number: 4,638,910

[45] Date of Patent: Jan. 27, 1987

[54] CLEANING WAND CADDY

[75] Inventor: David J. Bokmiller, San Antonio, Tex.

[73] Assignee: Sani-Fresh International, Inc., San Antonio, Tex.

[21] Appl. No.: 652,868

[22] Filed: Sep. 20, 1984

[51] Int. Cl.[4] ..... A45D 44/18

[52] U.S. Cl. ..... 206/15.2; 206/15.3; 206/581; 206/361; 312/206; 312/207; 248/110; 211/65; 211/66

[58] Field of Search ..... 206/15.2, 15.3, 349, 206/361, 557, 581, 427; 211/66, 65, 86; 312/206, 207; 248/110, 113; 220/22, 355

[56] References Cited

U.S. PATENT DOCUMENTS

| | | | |
|---|---|---|---|
| 1,289,025 | 12/1918 | Wever | 206/15.3 |
| 2,757,787 | 8/1956 | Sergent | 312/207 |
| 3,136,398 | 6/1964 | Platt | 220/22 |
| 3,361,507 | 1/1968 | O'Neil | 206/361 |
| 3,504,832 | 4/1970 | Corvetti | 206/557 |
| 3,560,101 | 2/1971 | Leland | 206/361 |
| 3,937,389 | 2/1976 | Wind | 206/557 |
| 3,990,755 | 11/1976 | Krause | 211/66 |
| 4,062,340 | 12/1977 | Huff | 220/235 |
| 4,210,068 | 7/1980 | Baker | 220/235 |
| 4,236,638 | 12/1980 | Griffith | 206/427 |
| 4,325,485 | 4/1982 | Pina et al. | 211/66 |
| 4,396,238 | 8/1983 | Torruella | 211/65 |

FOREIGN PATENT DOCUMENTS

| | | | |
|---|---|---|---|
| 1262536 | 3/1968 | Fed. Rep. of Germany | 206/361 |
| 477863 | 10/1969 | Switzerland | 206/361 |
| 611145 | 5/1979 | Switzerland | 206/15.2 |

*Primary Examiner*—Joseph Man-Fu Moy
*Assistant Examiner*—David T. Fidej
*Attorney, Agent, or Firm*—Joseph H. Yamaoka; J. W. Kane, Jr.

[57] ABSTRACT

A caddy assembly for storing a cleaning wand. The caddy includes a housing for storing the wand cleaning head, the wand handle extending downward through a groove in the housing. The caddy housing may be readily locked in an open or closed position by engaging the cleaning wand with the housing lid or a bracket mechanism, respectively. The assembly also includes apparatus for mounting the caddy in a vertical, upright position.

3 Claims, 8 Drawing Figures

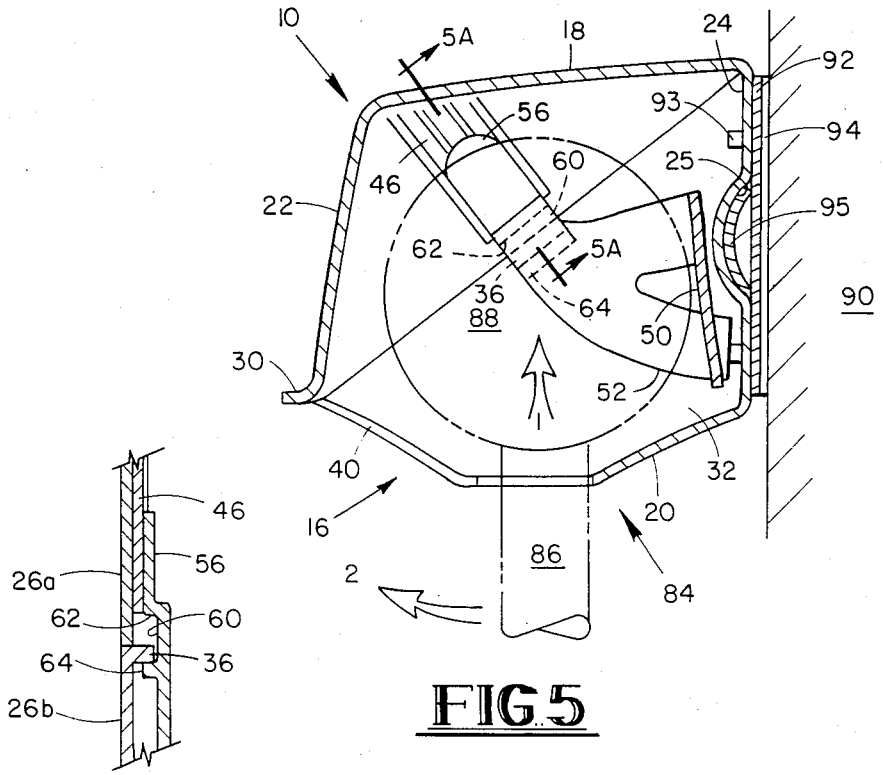
FIG.5
FIG.5A
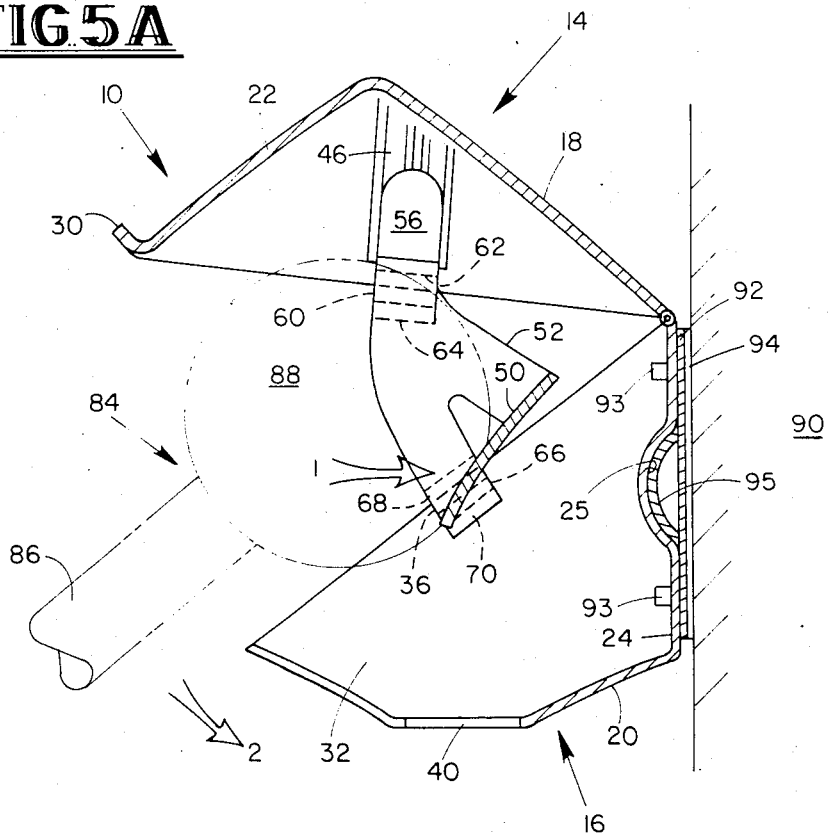
FIG.4

CLEANING WAND CADDY

BACKGROUND OF THE INVENTION

This invention relates to a caddy or receptacle for storing a cleaning wand.

The cleaning of lavatory facilities typically requires the utilization of a tool or wand comprising a handle with a brush or cleaning head connected thereto. When the cleaning wand is not in use, it is typically stored in a bucket or other receptacle. If the receptacle is of a type which is normally open, such as a bucket, the soiled cleaning head will be exposed to individuals in the vicinity of the receptacle. Further, the soiled cleaning head has a tendency to emit a repugnant odor if it is stored in an open receptacle.

Attempts to alleviate the problems inherent in the use of an open receptacle have resulted in the use of a type of receptacle which may be closed and which rests atop a horizontal surface. Such receptacles are adapted to receive the cleaning head therein in an upside down position with the handle extending vertically upward. However, such devices require the receptacle to be manually opened or closed, thereby exposing the users hands to contact with the soiled cleaning head. Further, such devices have a tendency to fall over and provide no means for securement to a vertical surface.

SUMMARY OF THE INVENTION

Accordingly, the present invention provides a caddy for storing a cleaning wand including a housing adapted to receive a cleaning head and a bracket mechanism connected to the housing for alternately locking the housing in an open or closed position. A method for storing a cleaning wand is also provided.

The caddy housing includes a lid hingedly connected to a base, the base having a groove therein through which to receive a cleaning wand handle. The bracket mechanism includes a first and second bracket connected on one end thereof to opposite sides of the lid. A press plate is connected to each of the brackets and extends across the cavity formed by the housing. Each bracket has a groove formed on each end thereof adapted for alternate engagement with or disengagement from a tongue which extends outward from each side of the base. A support plate or pair of straps are also disclosed for mounting the housing to a structure to permit storage of the wand in an upright position.

In order to remove the stored wand from the caddy, the wand handle is pressed upward, the wand head thereby pressing against and opening the lid. The bracket mechanism locks the lid in the open position while the wand is withdrawn therefrom and in use. After use, the wand head is pressed against the press plate by means of the handle, thereby disengaging the bracket mechanism and closing the lid. The lid thereafter remains in the closed, locked position until it is desired to again remove the wand for subsequent use.

The apparatus disclosed thus overcomes the limitations inherent in prior devices by providing a cleaning wand caddy wherein the cleaning head may be stored out of sight in a closed receptacle, the closed receptacle further prohibiting leakage of fluid or emission of odor from the soiled cleaning head. Further, the caddy permits the removal and storage of a cleaning wand in a closed receptacle without requiring the user to contact the receptacle or soiled cleaning head. Finally, the present assembly permits the caddy to be appropriately mounted in order to permit storage of a cleaning wand in a verticle, upright position.

BRIEF DESCRIPTION OF THE DRAWINGS

FIG. 4 is a cross sectional view of a preferred embodiment of a cleaning wand caddy illustrating the insertion of a cleaning wand into the caddy.

FIG. 5 is a cross sectional view of a preferred embodiment of a cleaning wand caddy illustrating the removal of a cleaning wand from the caddy.

FIG. 5A is a cross sectional view along section lines 5A—5A of FIG. 5 illustrating the caddy locking mode in the closed position.

DETAILED DESCRIPTION OF THE PREFERRED EMBODIMENT

Figure 1:
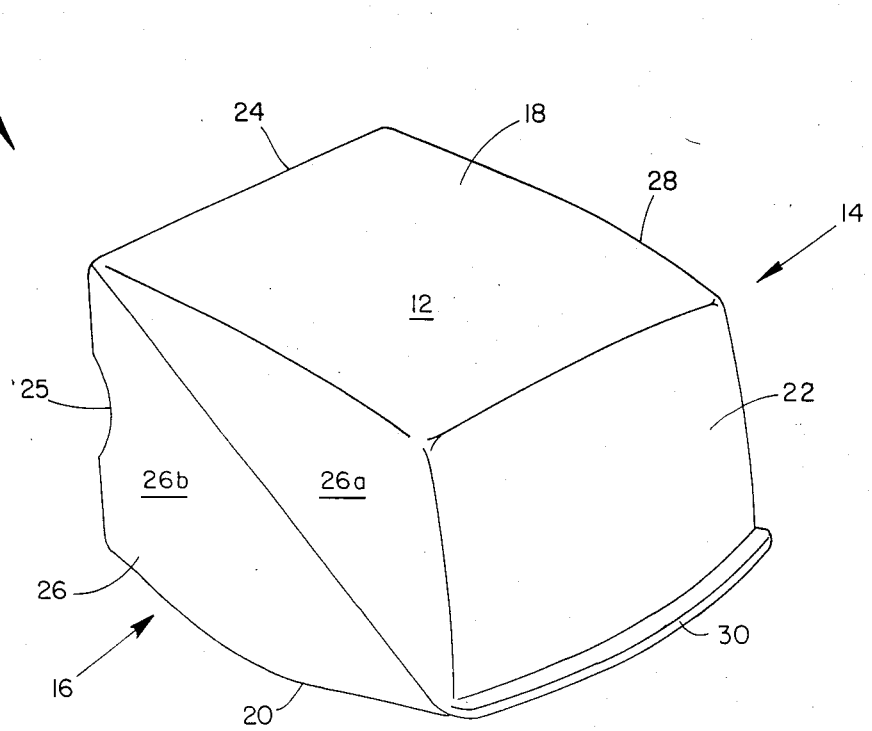
FIG. 1 is a perspective view of a preferred embodiment of a cleaning wand caddy in the closed and locked position.

Referring to FIG. 1, the preferred embodiment of a cleaning wand caddy is identified by the number 10. Caddy 10 comprises a housing 12 having a lid 14 and a base 16. The housing 12 comprises a top 18, a bottom 20, a front 22 and a rear 24. Rear 24 is provided with an arcuate indentation 25 across the middle thereof. The housing 12 is also provided with a first side 26 and a second side 28. As illustrated more clearly in FIG. 2 and FIG. 3, first side 26 is divided diagonally into first top side **26*a* and first bottom side 26*b* top side 26*a* forming a part of lid 14 and bottom side 26*b* forming a part of base 16. Likewise, second side 28 is divided diagonally into a second top side 28*a* and a second bottom side 28*b*, top side 28*a* forming a part of lid 14 and bottom side 28*b* forming a part of base 16. Referring again to FIG. 1, front 22 is provided with an integral lip 30** which extends outward therefrom along the lowermost portion thereof.

Figure 2:
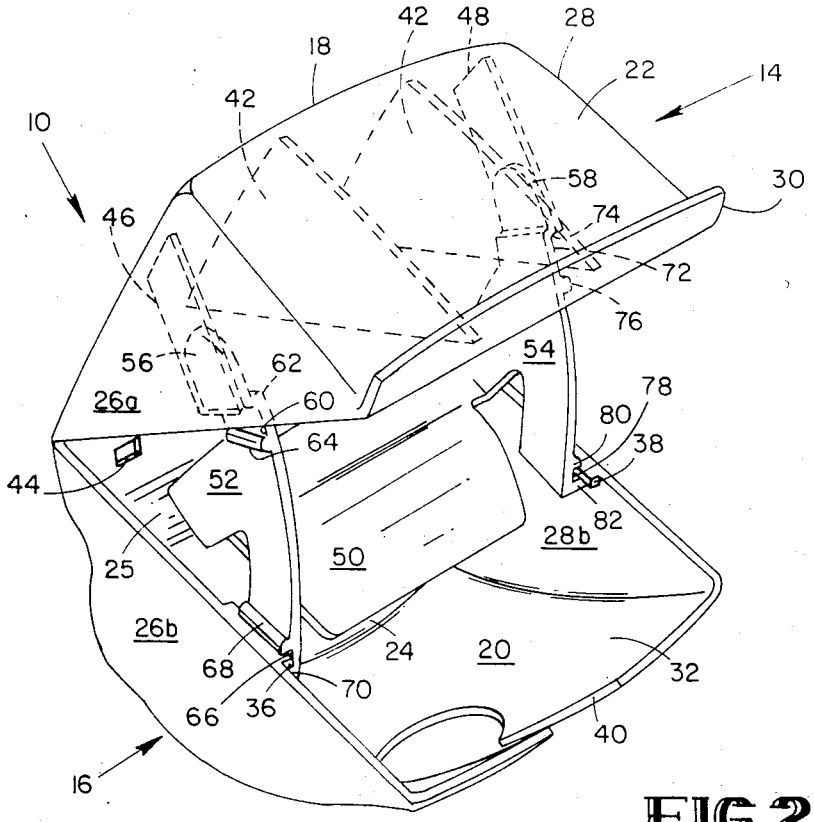
FIG. 2 is a perspective view of a preferred embodiment of a cleaning wand caddy in the open and locked position.
Figure 3:
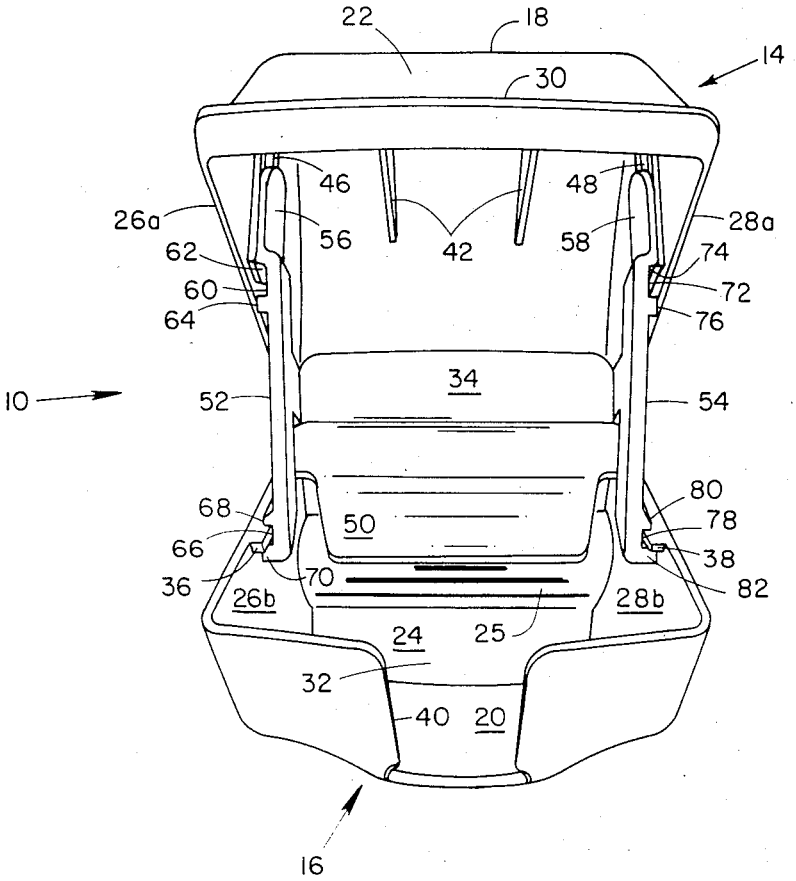
FIG. 3 is a frontal view of a preferred embodiment of a cleaning wand caddy in the open and locked position.

Referring to FIG. 2 and FIG. 3, the caddy 10 is shown in greater detail. The housing 12 is preferably an integral unit having a cavity 32 therein formed by lid 14 and base 16. Further, lid 14 may be integral with base 16, as illustrated in FIG. 2, or lid 14 may be connected to base 16 by means of hinge member 34, as illustrated in FIG. 3. In any event, lid 14 must be connected to base 16 to permit alternate opening of caddy 10, as illustrated in FIG. 2 and FIG. 3, or closure of caddy 10, as illustrated in FIG. 1.

Referring again to FIG. 2 and FIG. 3, bottom 20 is provided with a slot or groove 40 having a cylindrical shape in approximately the center of base 16. First bottom side **26*b* is provided with a first tongue or protruding boss 36 which is located on the uppermost portion of side 26*b* and extends perpendicularly inward into cavity 32. Likewise, second bottom side 28 is provided with a second tongue or protruding boss 38 which is located on the uppermost portion of side 28*b* and extends perpendicularly inward into cavity 32. Lid 14 is provided with a pair of rafters 42 on the inside thereof connected between top 18 and front 22. Rear 24 is provided with a plurality of holes 44 adapted for supporting caddy 10, as hereinafter described. First top side 26***a* and second top side 28*a* are provided with a plurality of ridges or raised bosses 46 and 48, respectively, on the inside surfaces thereof.

Referring once again to FIG. 2 and FIG. 3, the caddy 10 is provided with a cleaning head press plate 50 which extends across cavity 32 and is connected on opposite ends thereof to a first bracket 52 and a second bracket 54. Bracket 52 is glued or otherwise appropriately connected to lid 14 atop ridges 46 by means of integral extension tab 56. Likewise, second bracket 54 is glued or otherwise appropriately connected to lid 14 atop ridges 48 by means of integral extension tab 58. First bracket 52 has a groove or slot 60 on the uppermost end thereof defined by tab shoulder 62 and protruding boss 64. First bracket 52 also has a groove 66 on the lowermost portion thereof defined by raised bosses 68 and 70. Second bracket 54 likewise has a groove or slot 72 on the uppermost end thereof defined by second tab shoulder 74 and protruding boss 76. A groove or slot 78 is also located on the lowermost portion of second bracket 54 and is defined by raised bosses 80 and 82.

Referring to FIG. 4, a preferred method for storing a cleaning wand 84 within caddy 10 is shown in greater detail. A cleaning wand 84 typically comprises a handle 86 having a cleaning head or brush 88 connected thereto on one end thereof. As further illustrated in FIG. 4, caddy 10 is preferably mounted to a wall or other structure 90 in a vertical position by means of a support plate 92. Plate 92 may be provided with an adhesive surface 94 on the rear thereof for attaching plate 92 to wall 90 and a raised arcuate boss 95 for mating with arcuate indentation 25.

As illustrated in FIG. 2 and FIG. 3, caddy lid 14 may be locked in the open position by engagement of tongues 36 and 38 within grooves 66 and 78, respectively. However, when cleaning head 88 is pressed against plate 50, by handle 86, as illustrated by arrow number 1 in FIG. 4, brackets 52 and 54 will be disengaged from tongues 36 and 38, respectively, and lid 14 will be pulled downward into a closed and locked position, as illustrated in FIG. 1 and FIG. 5. The simultaneous insertion of handle 86 within groove 40, as illustrated by arrow number 2 in FIG. 4, will permit the ready storage of wand head 88 within the cavity 32 of caddy 10 with head 88 resting atop bottom 20 and handle 86 extending vertically downward through groove 40.

The method of removing the wand 84 from the cavity 10 is illustrated in FIG. 5. It is to be understood that in the closed position shown in FIG. 1 and FIG. 5, lid 14 will be in locked engagement with base 16 due to the engagement of tongues 36 and 38 within grooves 60 and 72, respectively, the former being clearly illustrated in FIG. 5A. The wand 84 is removed from caddy 10 by grasping handle 86 and pressing upward thereon, as illustrated by arrow number 1 in FIG. 5, thereby causing cleaning head 88 to abut against rafters 42 and/or lid 14. The handle 86 is simultaneously pulled outward from caddy 10, as illustrated by arrow number 2 in FIG. 5, through groove 40. It is to be understood that as head 88 is pressed upward, lid 14 will open and remain in its open, locked position, as illustrated in FIG. 2 and FIG. 3, until wand 84 is again stored within caddy 10, as previously described.

Figure 6:
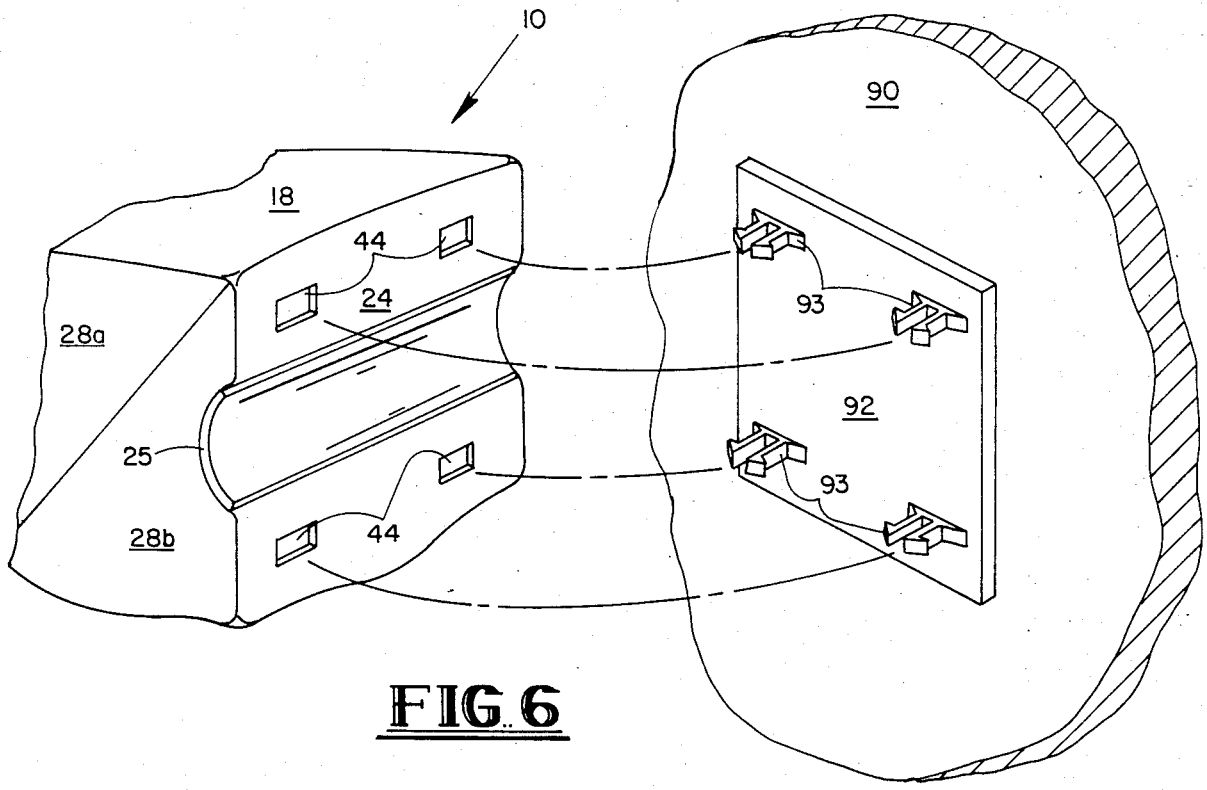
FIG. 6 is a perspective view of a preferred embodiment of a cleaning wand caddy assembly illustrating a method for supporting the caddy.

Referring to FIG. 6, a preferred method for attaching caddy 10 to a wall or other support 90 is shown in greater detail. A support plate 92 having a plurality of integral clips or barbs 93 is initially attached to wall 90 by an adhesive or other means. Each of the respective clips 93 is thereafter inserted in the holes 44 in the rear 24 of caddy 10. Caddy 10 can thereafter be removed from wall 90 by simply withdrawing resilient clips 93 from holes 44.

Figure 7:
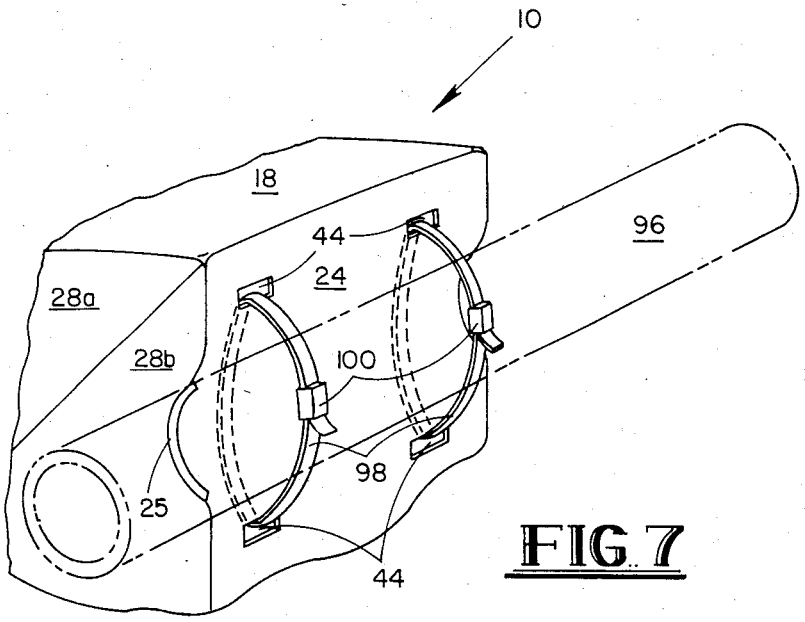
FIG. 7 is a perspective view of a preferred embodiment of a cleaning wand caddy assembly illustrating an alternate method for supporting the caddy.

Referring to FIG. 7, an alternate preferred method of supporting the caddy 10 is shown in greater detail. In this embodiment, the caddy 10 is attached to a dowel or similar shaped structure 96 by means of straps 98. The caddy 10 is placed against the dowel 96 in mating engagement with indentation 25. Straps 98 are thereafter inserted through holes 44 and about dowel 96 and secured by an appropriate locking tab or buckle 100. Caddy 10 may also be readily removed from dowel 96 by disconnecting straps 98.

Caddy 10 is preferably manufactured of molded plastic (homopolymer polypropylene) in an appropriate size and shape to accommodate the cleaning wand 84 to be stored. It is to be understood that press plate 50 is preferably integral with brackets 52 and 54, that tongues 36 and 38 are preferably integral with sides 26*b* and 28*b*, respectively, that bosses 64, 68, and 70 and bosses 76, 80, and 82, are preferably integral with brackets 52 and 54, respectively. It is also to be understood that caddy 10 may be manually opened or closed by means of lip 30 on lid 14. Finally, it is to be understood that dowel 96 may be vertical or horizontal and that caddy 10 may be mounted in a vertical, upright position by adjusting straps 98 accordingly.

While the cleaning wand caddy and method for using same have been described in connection with the preferred embodiment, it is not intended to limit the invention to the particular form set forth, but on the contrary, it is intended to cover such alternatives, modificiations, and equivalents as may be included within the spirit and scope of the invention as defined by the appended claims.

I claim:

1. A housing for storing a cleaning wand in an upright position, comprising:

a base comprising a bottom, first and second base side walls, and a rear wall, said bottom for supporting a head of said wand thereon during storage of said wand and having a groove therein through which to receive a handle of said wand during storage of said wand;

a lid comprising a top, first and second lid side walls, and a front wall, said lid hingedly connected to a top of said rear wall atop said base for placing said housing in an open position upon engagement of said wand head with said lid;

a press plate connected to said lid for placing said housing in a closed position upon engagement of said wand head with said press plate, said housing permitting said wand to be stored in said upright position with said wand handle extending vertically downward relative to said head; and means for alternately locking said housing in said open position or said closed position, wherein said means for alternately locking said housing in said open or closed position comprises:

a first bracket connected to said first side wall of said lid;

a second bracket connected to said second side wall of said lid, said press plate connected to said first bracket and said second bracket;

a first inwardly protruding boss on said first side wall of said base, said first protruding boss adapted for alternate engagement with or disengagement from an uppermost groove on said first bracket and a lowermost groove on said first bracket; and a second inwardly protruding boss on said second side wall of said base, said second protruding boss adapted for alternate engagement with or disengagement from an uppermost groove on said second bracket and a lowermost groove on said second bracket.

2. A housing for storing a cleaning wand in an upright position, comprising:

a base for supporting a head of said wand thereon having a groove therein through which to receive a handle of said wand;

a lid connected to said base for placing said housing in an open position upon engagement of said wand head with said lid;

a press plate connected to said lid for placing said housing in a closed position upon engagement of said wand head with said press plate;

means for alternately locking said housing in said open position or said closed position comprising:

a first bracket connected to a first side of said lid;

a second bracket connected to a second side of said lid, said press plate connected to said first bracket and said second bracket;

a first inwardly protruding boss on a first side of said base, said first protruding boss adapted for alternate engagement with or disengagement from an uppermost groove on said frist bracket and a lowermost groove on said first bracket;

a second inwardly protruding boss on a second side of said base, said second protruding boss adapted for alternate engagement with or disengagement from an uppermost groove on said second bracket and a lowermost groove on said second bracket; and means for mounting said housing to a structure to permit said storage of said wand in said upright position.

3. A housing for storing a cleaning wand in an upright position, comprising:

a base for supporting a head of said wand thereon having a groove therein through which to receive a handle of said wand;

a lid connected to said base for placing said housing in an open position upon engagement of said wand head with said lid;

a press plate connected to said lid for placing said housing in a closed position upon engagement of said wand head with said press plate; and means for alternately locking said housing in said open position or said closed position, comprising:

a first bracket connected to a first side of said lid;

a second bracket connected to a second side of said lid, said press plate connected to said first bracket and said second bracket;

a first inwardly protruding boss on a first side of said base, said first protruding boss adapted for alternate engagement with or disengagement from an uppermost groove on said first bracket and a lowermost groove on said first bracket; and a second inwardly protruding boss on a second side of said base, said second protruding boss adapted for alternate engagement with or disengagement from an uppermost groove on said second bracket and a lowermost groove on said second bracket.

* * * * *